US010914208B2

(12) United States Patent
Komada et al.

(10) Patent No.: US 10,914,208 B2
(45) Date of Patent: Feb. 9, 2021

(54) IN-VEHICLE INTERNAL COMBUSTION ENGINE

(71) Applicant: TOYOTA JIDOSHA KABUSHIKI KAISHA, Toyota (JP)

(72) Inventors: Atsushi Komada, Nagakute (JP); Kunihiko Sakata, Nagakute (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/259,263

(22) Filed: Jan. 28, 2019

(65) Prior Publication Data

US 2019/0234259 A1 Aug. 1, 2019

(30) Foreign Application Priority Data

Feb. 1, 2018 (JP) ..... 2018-016503

(51) Int. Cl.
*F01M 11/02* (2006.01)
*F02F 1/14* (2006.01)
(Continued)

(52) U.S. Cl.
CPC ..... *F01M 11/02* (2013.01); *F01M 11/0004* (2013.01); *F01P 3/02* (2013.01); *F01M 1/04* (2013.01); *F01M 2011/0033* (2013.01); *F01M 2011/022* (2013.01); *F01M 2011/023* (2013.01); *F02F 1/14* (2013.01); *F02F 1/36* (2013.01)

(58) Field of Classification Search
CPC ..... F01M 11/02; F01M 11/0004; F01M 2011/0033; F01M 2011/023; F01M 1/04; F01M 2011/022; F01P 3/02; F02F 1/14; F02F 1/36
See application file for complete search history.

(56) References Cited

U.S. PATENT DOCUMENTS 5,123,385 A * 6/1992 Sado ..... F01L 1/02 123/193.5
8,714,133 B2 * 5/2014 Bicker ..... F01M 11/02 123/196 CP
(Continued)

FOREIGN PATENT DOCUMENTS

JP 6-8733 U 2/1994
JP 2014-43824 3/2014
(Continued)

*Primary Examiner* — Syed O Hasan
(74) *Attorney, Agent, or Firm* — Oblon, McClelland, Maier & Neustadt, L.L.P.

(57) ABSTRACT

An in-vehicle internal combustion engine includes a cylinder block and a cylinder head. The cylinder head includes a plurality of communication passages connected to the oil chamber. The cylinder block includes an oil passage for returning oil accumulated in the oil chamber into the oil pan. The communication passages include a first communication passage having a first opening opened in the upper surface of the cylinder head and a second communication passage having a second opening opened in the upper surface of the cylinder head. The first opening is located below the second opening. An extending wall extending in a direction intersecting the cylinder arrangement direction is provided between the first opening and the second opening on the upper surface of the cylinder head.

6 Claims, 4 Drawing Sheets

(51) Int. Cl.

| | |
|---|---|
| ***F01M 11/00*** | (2006.01) |
| ***F01P 3/02*** | (2006.01) |
| *F02F 1/36* | (2006.01) |
| *F01M 1/04* | (2006.01) |

(56) References Cited

U.S. PATENT DOCUMENTS

| | | | | |
|---|---|---|---|---|
| 2004/0244783 | A1* | 12/2004 | Ookawa | F01M 13/022 123/572 |
| 2015/0226328 | A1* | 8/2015 | Horie | F01M 11/02 92/169.1 |
| 2015/0252749 | A1 | 9/2015 | Kobayashi et al. | |
| 2017/0175601 | A1* | 6/2017 | Usa | F02F 1/24 |
| 2019/0234257 | A1 | 8/2019 | Hirota et al. | |

FOREIGN PATENT DOCUMENTS

| | | |
|---|---|---|
| JP | 2014-114711 | 6/2014 |
| JP | 2019-132234 A | 8/2019 |

* cited by examiner

IN-VEHICLE INTERNAL COMBUSTION ENGINE

BACKGROUND

The present disclosure relates to an in-vehicle internal combustion engine configured so that oil returns from a space above the cylinder head to the oil pan through the inside of the cylinder head and the inside of the cylinder block.

In the internal combustion engine described in Japanese Laid-Open Patent Publication No. 2014-114711, an oil chamber is formed in the cylinder block by closing a recess provided in the cylinder block with the cylinder head. The oil in the space above the head existing above the cylinder head flows into the oil chamber through a communication passage provided in the cylinder head. The oil accumulated in the oil chamber returns into the oil pan through an oil passage provided in the cylinder block.

The oil chamber is disposed on the opposite side of the water jacket formed inside the cylinder block from the cylinder. That is, the water jacket exists between the oil chamber and the cylinder. In order to effectively cool the oil circulating in the internal combustion engine by cooling water flowing through the water jacket, the oil chamber is formed to extend in the cylinder arrangement direction so that the volume of the oil chamber increases. The cylinder arrangement direction is a direction in which the cylinders are arranged in the cylinder block.

When the amount of oil flowing into the space above the head increases due to increase in the engine rotation speed or the engine load factor, and the like, the amount of oil flowing into the oil chamber through the communication passage increases and the pressure inside the oil chamber increases. Furthermore, when the engine rotation speed or the engine load factor increases, the pressure in the crankcase of the internal combustion engine and in the oil pan may increase. In this case, the blow-by gas in the crankcase flows backward through the oil passage and flows into the oil chamber. As a result, not only oil but also gas such as blow-by gas accumulates in the oil chamber. When the pressure in the oil chamber increases, the pressure in a gas accumulating region, which is a region where the gas is accumulated, in the oil chamber also increases. When such a gas accumulating region is formed in the vicinity of a portion connected to the communication passage in the oil chamber, the inflow of the oil from the space above the head to the oil chamber through the communication passage is hindered by the gas in the gas accumulating region. As a result, the amount of oil returned into the oil pan through the oil chamber is reduced, and the retained amount of oil in the oil pan is reduced.

Therefore, there is room for improvement in that it is possible to prevent the oil in the space above the head from being less likely to flow into the oil chamber through the communication passage.

SUMMARY

In accordance with one aspect of the present disclosure, an in-vehicle internal combustion engine that includes a cylinder block and a cylinder head is provided. The cylinder block has a plurality of cylinders arranged in a cylinder arrangement direction and a recess. The cylinder head is attached to the cylinder block. The cylinder head closes the recess to form an oil chamber in the cylinder block. The cylinder head includes a plurality of communication passages opened in an upper surface of the cylinder head and connected to the oil chamber. The communication passages are arranged in the cylinder arrangement direction. The cylinder block includes an oil passage for returning oil accumulated in the oil chamber into an oil pan. The communication passages include a first communication passage having a first opening opened in the upper surface of the cylinder head and a second communication passage having a second opening opened in the upper surface of the cylinder head. The first opening is located below the second opening. An extending wall extending in a direction intersecting the cylinder arrangement direction is provided between the first opening and the second opening on the upper surface of the cylinder head.

According to the configuration described above, the upper surface of the cylinder head is configured so that the first opening is located below the second opening. Furthermore, the extending wall is disposed between the first opening and the second opening on the upper surface of the cylinder head. Therefore, the oil that has flowed into the space above the head, located above the cylinder head, is more likely to be guided to the first opening than to the second opening, and is likely to flow into the first communication passage. That is, the oil in the space above the head is less likely to be guided to the second opening, and is less likely to flow into the second communication passage. Therefore, since the gas accumulated in the oil chamber can be discharged to the outside of the oil chamber through the second communication passage, the amount of gas that continues to be accumulated in the oil chamber is reduced. As a result, the inflow of the oil from the space above the head to the oil chamber through the first communication passage is less likely to be hindered by the gas accumulated in the oil chamber.

Therefore, according to the configuration described above, the oil in the space above the head is prevented from becoming less likely to flow into the oil chamber, and it is possible to suppress the decrease in the oil retaining amount in the oil pan.

A connecting portion of the oil passage with respect to the oil chamber may be located closer to a connecting portion of the second communication passage with respect to the oil chamber than a connecting portion of the first communication passage with respect to the oil chamber. According to this configuration, the gas flowing into the oil chamber from the oil pan through the oil passage more easily accumulates in the vicinity of the connecting portion of the second communication passage with respect to the oil chamber than in the vicinity of the connecting portion of the first communication passage with respect to the oil chamber. Therefore, the gas accumulated in the oil chamber is easily discharged to the outside of the oil chamber through the second communication passage, and the gas accumulated in the oil chamber is more effectively prevented from hindering the flow of oil from the space above the head to the oil chamber through the first communication passage.

The cylinder block may include a partition wall that partitions the oil chamber into a first oil division chamber and a second oil division chamber adjacent to the first oil division chamber in the cylinder arrangement direction. The first communication passage may be connected to the first oil division chamber and is not connected to the second oil division chamber. The second communication passage and the oil passage do not necessarily need to be connected to the first oil division chamber and may be connected to the second oil division chamber. The partition wall may include a through-hole that allows the first oil division chamber and the second oil division chamber to communicate with each other.

According to the configuration described above, the gas flowing backward through the oil passage flows into the second oil division chamber. Since the partition wall is disposed between the second oil division chamber and the first oil division chamber, the gas accumulated in the second oil division chamber is prevented from flowing into the first oil chamber. Therefore, the inflow of the oil to the first oil division chamber through the first communication passage is prevented from being hindered by the gas flowing backward into the oil chamber through the oil passage. In addition, since the second communication passage is connected to the second oil division chamber, the gas accumulated in the second oil division chamber can be discharged to the outside of the oil chamber through the second communication passage. Therefore, the oil in the space above the head easily flows into the first oil division chamber through the first communication passage. The oil that has flowed into the first oil division chamber flows into the second oil division chamber through the through-hole and is returned from the second oil division chamber into the oil pan through the oil passage.

The vehicle may accelerate in the cylinder arrangement direction depending on the traveling mode of the vehicle. In this case, in the space above the head, the inertial force of the oil facilitates the movement of the oil to the outer side in the cylinder arrangement direction of the space above the head. In this regard, the first communication passage may be disposed closer to an outer side of the cylinder head than the second communication passage in the cylinder arrangement direction.

According to the configuration described above, even in the case where the vehicle accelerates in the cylinder arrangement direction, the state in which the oil in the space above the head easily flows into the oil chamber through the first communication passage can be maintained, and the state in which the gas accumulated in the oil chamber is easily discharged to the outside of the oil chamber through the second communication passage can be maintained.

In the cylinder head, at the portion between the two exhaust passages adjacent to each other in the cylinder arrangement direction, the temperature tends to be higher than the other portions due to the heat of the exhaust gas flowing through the two exhaust passages. In this regard, the second communication passage may be disposed between the exhaust passages adjacent to each other in the cylinder arrangement direction, and the first communication passage may be disposed closer to an outer side of the cylinder head than the exhaust passages in the cylinder arrangement direction. According to such a configuration, since the first communication passage is not disposed between the exhaust passages, the temperature rise of the oil flowing toward the oil chamber in the first communication passage is suppressed. Furthermore, since the second communication passage is not disposed closer to the outer side of the cylinder head than the first communication passage in the cylinder arrangement direction, the enlargement of the internal combustion engine in the cylinder arrangement direction is suppressed.

A passage cross-sectional area of the first communication passage may be larger than a passage cross-sectional area of the second communication passage. According to this configuration, the oil in the space above the head easily flows into the first communication passage by increasing the passage cross-sectional area of the first communication passage.

The recess may be a first recess, and the oil chamber may be a first oil chamber. The cylinder block may include a second recess arranged side by side with the first recess in the cylinder arrangement direction and a partition wall located between the first and second recesses. The cylinder head may close the second recess to form a second oil chamber arranged in the cylinder arrangement direction with the first oil chamber with the partition wall therebetween in the cylinder block. The cylinder head may include a third communication passage opened in the upper surface of the cylinder head and communicating with the second oil chamber. The oil passage may be connected to both the first oil chamber and the second oil chamber. The partition wall may include a connection hole for allowing the first oil chamber and the second oil chamber to communicate with each other. In this case, the oil in the space above the head can flow into the second oil chamber through the third communication passage, and the oil accumulated in the second oil chamber can be returned into the oil pan through the oil passage.

In such a configuration, gas may flow from the oil pan into the second oil chamber through the oil passage, and the gas may accumulate in the second oil chamber, similarly to the first oil chamber. When the pressure in the second oil chamber rises, the inflow of the oil from the space above the head to the second oil chamber through the third communication passage may be hindered by the gas accumulated in the second oil chamber.

Therefore, in the in-vehicle internal combustion engine, the partition wall may include a connection hole for allowing the first oil chamber and the second oil chamber to communicate with each other. According to this configuration, the gas accumulated in the second oil chamber can be discharged to the first oil chamber through the connection hole. Thus, the amount of gas accumulated in the second oil chamber can be reduced, and as a result, the inflow of the oil from the space above the head to the second oil chamber through the third communication passage is prevented from being hindered by the gas accumulated in the second oil chamber.

The gas discharged from the second oil chamber to the first oil chamber through the connection hole is discharged to the outside through the second communication passage.

In the above-described in-vehicle internal combustion engine, the upper surface of the cylinder head may include a flow-down surface formed between the extending wall and the first opening so as to be located more downward as the flow-down surface approaches the first opening in the cylinder arrangement direction. The flow-down surface may be disposed immediately above a cooling water passage provided inside the cylinder head.

According to the configuration described above, when the oil that has flowed into the space above the head flows toward the first opening along the flow-down surface, the oil is cooled by the cooling water flowing through the cooling water passage in the cylinder head. Therefore, the oil can be cooled in the process of returning the oil to the oil pan.

Other aspects and advantages of the present disclosure will become apparent from the following description, taken in conjunction with the accompanying drawings, illustrating exemplary embodiments.

BRIEF DESCRIPTION OF THE DRAWINGS

The disclosure may be understood by reference to the following description together with the accompanying drawings.

DETAILED DESCRIPTION

An internal combustion engine 10 according to an embodiment will now be described with reference to FIGS. 1 to 5.

Figure 1:
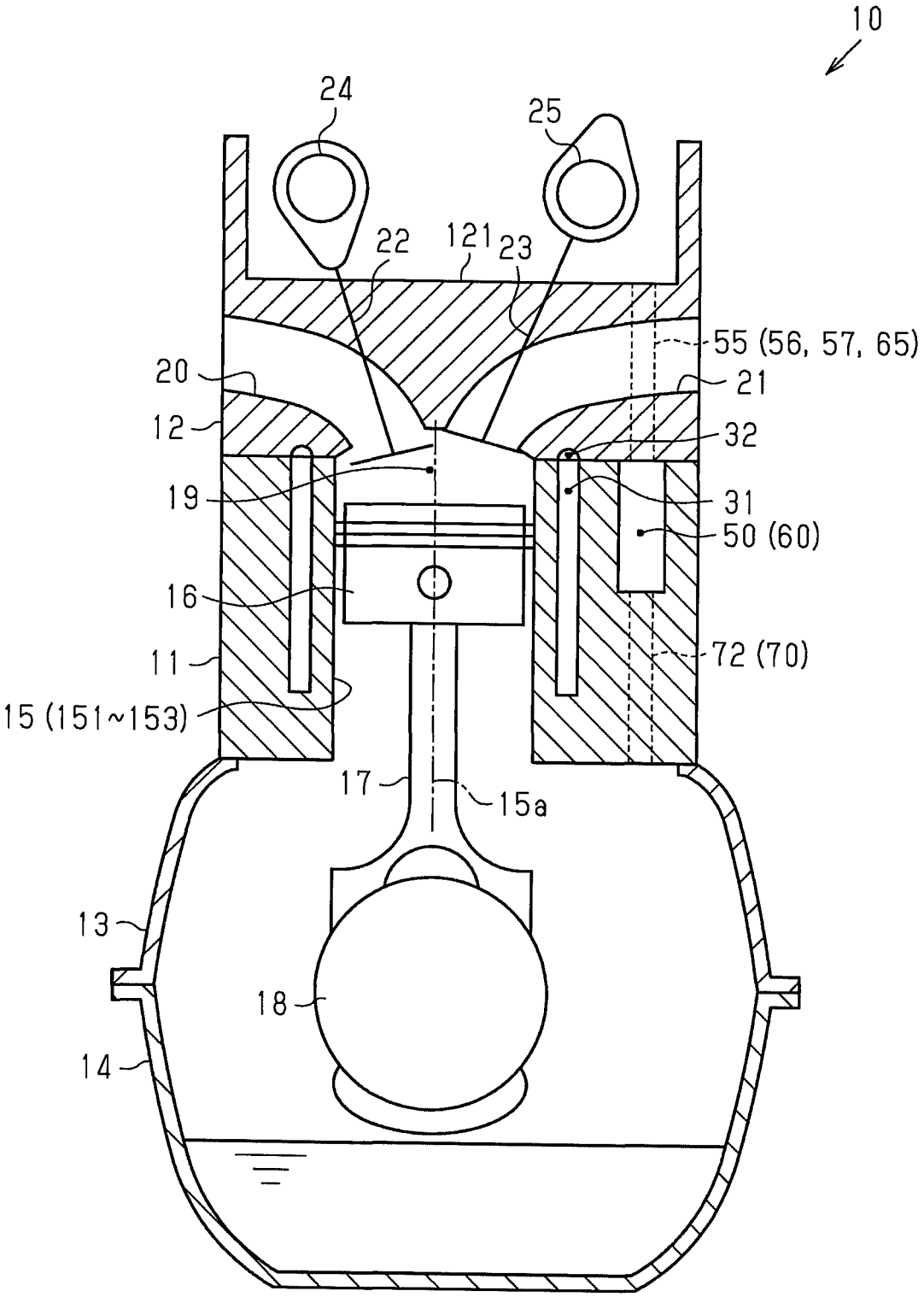
FIG. 1 is a cross-sectional view schematically showing an internal combustion engine according to one embodiment.

As shown in FIG. 1, the internal combustion engine 10 mounted on a vehicle includes a cylinder block 11 and a cylinder head 12 attached to an upper portion of the cylinder block 11. The internal combustion engine 10 also includes a crankcase 13 attached to a lower portion of the cylinder block 11 and an oil pan 14 attached to a lower portion of the crankcase 13. The oil retained in the oil pan 14 is pumped up by an oil pump and is supplied to each oil requiring portion in the internal combustion engine 10.

Figure 2:
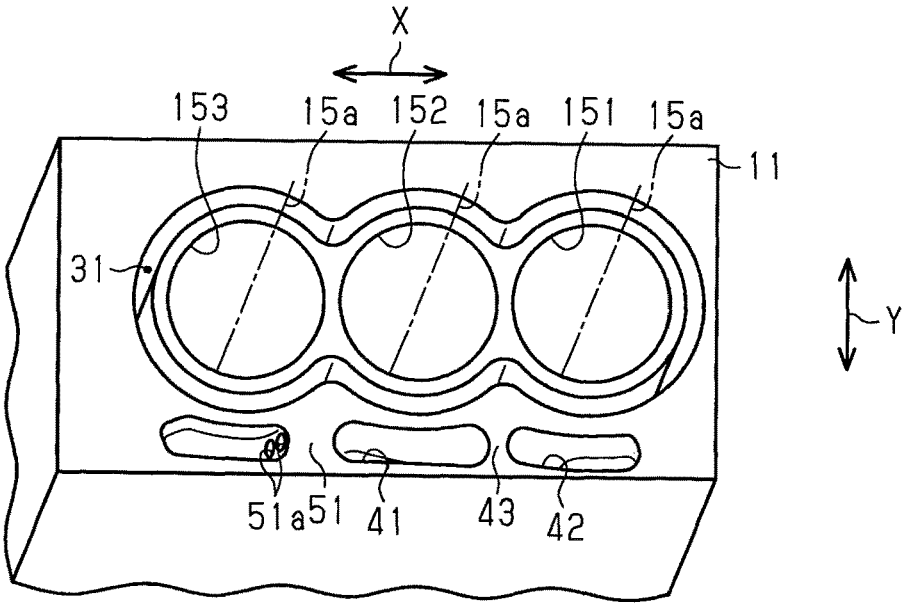
FIG. 2 is a perspective view schematically showing a part of a cylinder block of the internal combustion engine of FIG. 1.

As shown in FIGS. 1 and 2, a plurality (three in the present embodiment) of cylinders 15 (151, 152, 153) are provided in the cylinder block 11. The direction in which the plurality of cylinders 15 are arranged in the cylinder block 11 is referred to as cylinder arrangement direction X. Among the plurality of cylinders 15, a cylinder located at one end (right end in FIG. 2) in the cylinder arrangement direction X is the first cylinder 151, a cylinder located at the other end (left end in FIG. 2) in the cylinder arrangement direction X is the third cylinder 153, and a cylinder located between the first cylinder 151 and the third cylinder 153 is the second cylinder 152. A piston 16 that reciprocates in the vertical direction in FIG. 1 is provided in each of the cylinders 151 to 153. These pistons 16 are coupled to the crankshaft 18 by way of a connecting rod 17. The crankshaft 18 is disposed in a space defined by the crankcase 13 and the oil pan 14.

A combustion chamber 19 is defined by a peripheral wall of each of the cylinders 151 to 153, each of the pistons 16, and the cylinder head 12. In each combustion chamber 19, a mixed air containing the intake air introduced into the combustion chamber 19 through a corresponding intake passage 20 and the fuel injected from a fuel injection valve is burned. The exhaust gas generated in each combustion chamber 19 by the combustion of the mixed air is discharged to a corresponding exhaust passage 21.

The opening and closing of the intake passage 20 with respect to each combustion chamber 19 is performed by an intake valve 22, and the opening and closing of the exhaust passage 21 with respect to each combustion chamber 19 is performed by an exhaust valve 23. The intake valve 22 operates in synchronization with the rotation of an intake camshaft 24. Further, the exhaust valve 23 operates in synchronization with the rotation of an exhaust camshaft 25.

Figure 3:
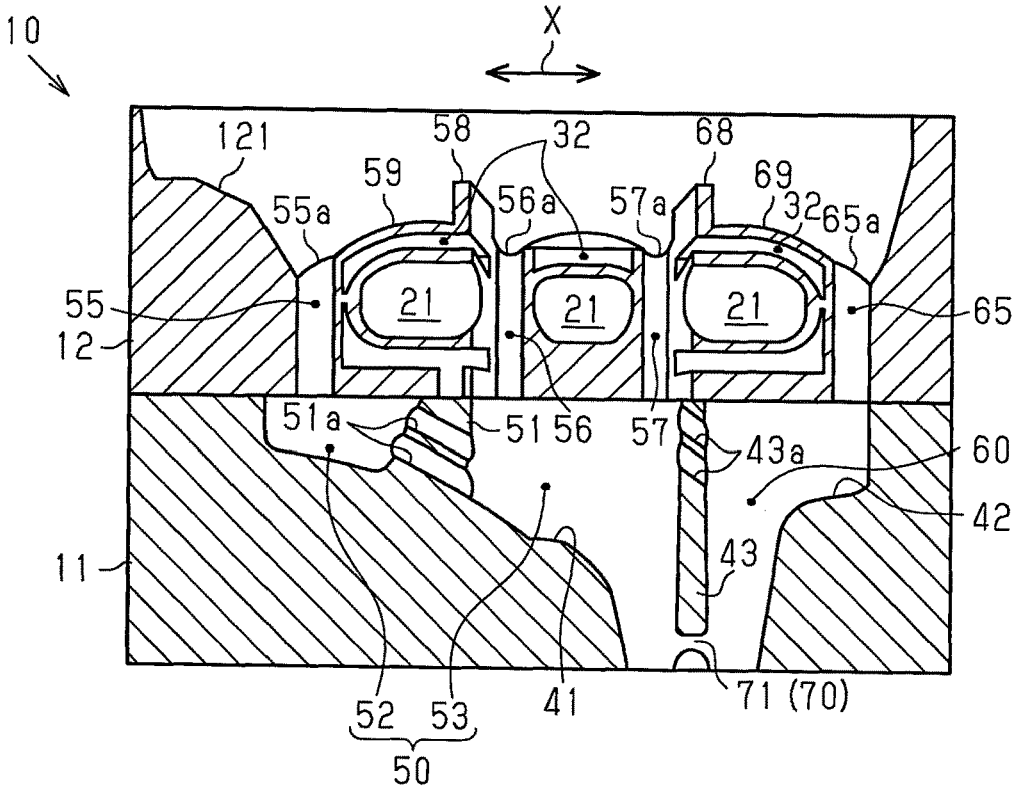
FIG. 3 is a view schematically showing a cross section of the cylinder block and a cross section of a cylinder head in the internal combustion engine of FIG. 1.

As shown in FIGS. 1 and 2, a block side cooling water passage 31 through which cooling water flows is provided in the cylinder block 11 so as to surround all the cylinders 151 to 153. As shown in FIGS. 1 and 3, a head-side cooling water passage 32 through which cooling water flows is provided in the cylinder head 12. In the present embodiment, a part of the cooling water flowing through the block side cooling water passage 31 flows into the head-side cooling water passage 32.

A direction orthogonal to both the extending direction of a central axis 15*a* of each of the cylinders 151 to 153 and the cylinder arrangement direction X is referred to as a specified direction Y. As shown in FIGS. 2 and 3, a first recess 41 and a second recess 42 arranged in the cylinder arrangement direction X are provided closer to the outer side of the cylinder block 11 than the block side cooling water passage 31 in the specified direction Y. In the cylinder arrangement direction X, the first recess 41 and the second recess 42 are adjacent to each other with a partition wall 43 interposed therebetween. The first recess 41 and the second recess 42 are opened on the upper surface of the cylinder block 11. As shown in FIG. 2, the partition wall 43 is disposed between the central axis 15*a* of the first cylinder 151 and the central axis 15*a* of the second cylinder 152 in the cylinder arrangement direction X.

As shown in FIG. 3, each recess 41, 42 (more specifically, opening of each recess 41, 42) is closed by the cylinder head 12. Thus, a first oil chamber 50 and a second oil chamber 60 adjacent to each other in the cylinder arrangement direction X are formed in the cylinder block 11. In the present embodiment, both oil chambers 50, 60 are formed so that the volume of the second oil chamber 60 is smaller than the volume of the first oil chamber 50.

Among the two ends of the first oil chamber 50 in the cylinder arrangement direction X, the end (left end in FIG. 3), which is distant from the second oil chamber 60, is located farther away from the center of the cylinder block 11 in the cylinder arrangement direction X than the central axis 15*a* of the third cylinder 153. The depth of the first oil chamber 50, which is the length in the vertical direction of the first oil chamber 50, becomes deeper as it approaches the second oil chamber 60 in the cylinder arrangement direction X. The first oil chamber 50 is partitioned into a first oil division chamber 52 and a second oil division chamber 53 by a partition wall 51 provided in the cylinder block 11. The second oil division chamber 53 is arranged closer to the second oil chamber 60 than the first oil division chamber 52. That is, the second oil division chamber 53 is disposed between the first oil division chamber 52 and the second oil chamber 60. Furthermore, the first oil division chamber 52 and the second oil division chamber 53 communicate with each other through a through-hole 51*a* provided in the partition wall 51. In the present embodiment, two through-holes 51*a* are arranged in the vertical direction. Each through-hole 51*a* is formed so as to be located downward in the cylinder arrangement direction X as it separates away from the first oil division chamber 52. That is, the extending direction of each through-hole 51*a* is inclined with respect to the cylinder arrangement direction X.

Among the two ends of the second oil chamber 60 in the cylinder arrangement direction X, the end (right end in FIG. 3), which is distant from the first oil chamber 50, is located farther away from the center of the cylinder block 11 in the cylinder arrangement direction X than the central axis 15*a* of the first cylinder 151. The depth of the second oil chamber 60, which is the length in the vertical direction of the second oil chamber 60, becomes deeper as it approaches the first oil chamber 50 in the cylinder arrangement direction X.

The cylinder block 11 includes a collecting portion 71 that connects the second oil division chamber 53 and the second oil chamber 60 below the partition wall 43. An oil flow-down passage 72 (see FIG. 1) for allowing the oil accumulated in each of the oil chambers 50, 60 to flow down toward the oil pan 14 is connected to the collecting portion 71. That is, in the present embodiment, the collecting portion 71 and the oil flow-down passage 72 are connected to both the first oil chamber 50 and the second oil chamber 60, and configure an oil passage 70 for returning the oil accumulated in each of the oil chambers 50, 60 into the oil pan 14. In the present embodiment, the oil passage 70 is connected to the second oil division chamber 53, but is not connected to the first oil division chamber 52.

In addition, the partition wall 43 is provided with a connection hole 43*a* that allows the second oil division chamber 53 and the second oil chamber 60 to communicate with each other. In the present embodiment, a plurality (two in FIG. 3) of connection holes 43*a* are arranged in the vertical direction. In addition, each of the connection holes 43*a* is arranged at a portion above the center in the vertical direction of the partition wall 43. Furthermore, the extending direction of each connection hole 43*a* is inclined with respect to the cylinder arrangement direction X. Specifically, each connection hole 43*a* is formed so as to be located downward as it approaches the second oil chamber 60.

Figure 4:
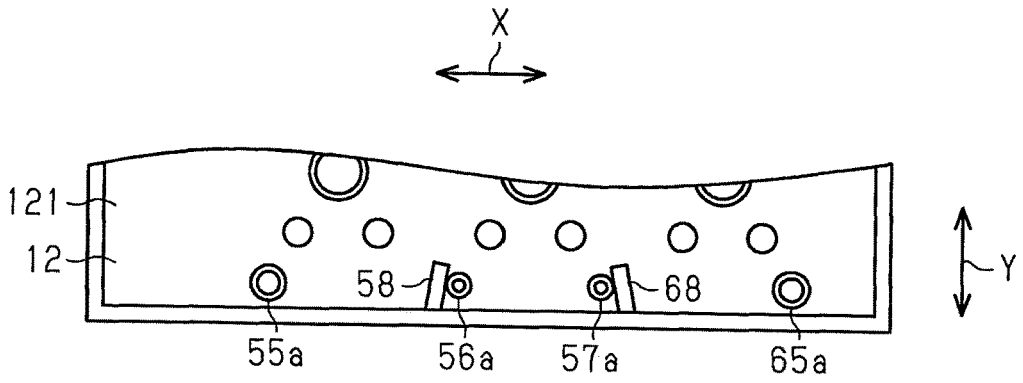
FIG. 4 is a plan view schematically showing a part of an upper surface of the cylinder head of FIG. 3.

As shown in FIGS. 3 and 4, the cylinder head 12 is provided with a plurality of (three in FIG. 3) communication passages 55, 56, 57 opened in the upper surface 121 of the cylinder head 12 and connected to the first oil chamber 50. The communication passages 55 to 57 extend substantially in the vertical direction. The communication passages 55 to 57 include a first communication passage 55 located on the leftmost side and remaining second communication passages 56 and 57. The first communication passage 55 is connected to the first oil division chamber 52 but is not connected to the second oil division chamber 53. The second communication passages 56, 57 are connected to the second oil division chamber 53, but are not connected to the first oil division chamber 52. The passage cross-sectional area of the first communication passage 55 is greater than the passage cross-sectional area of teach of the second communication passages 56, 57.

A space above the head exists on the cylinder head 12. The space above the head is a space that makes contact with the upper surface 121 of the cylinder head 12.

The first communication passage 55 is disposed closer to the outer side of the cylinder head 12 (closer to left in FIG. 3) than the second communication passages 56, 57 in the cylinder arrangement direction X. In the example shown in FIG. 3, the number of first communication passages 55 is one, and the number of the second communication passages 56, 57 is two. Furthermore, the second communication passages 56, 57 are arranged between the exhaust passages 21 adjacent to each other in the cylinder arrangement direction X. On the other hand, the first communication passage 55 is disposed closer to the outer side of the cylinder head 12 (closer to left in FIG. 3) than all the exhaust passages 21 in the cylinder arrangement direction X.

The cylinder head 12 is provided with a third communication passage 65 opened in the upper surface 121 of the cylinder head 12 and connected to the second oil chamber 60. The third communication passage 65 is disposed on the opposite side of the second communication passages 56, 57 from the first communication passage 55 in the cylinder arrangement direction X. That is, the third communication passage 65 is disposed closer to the outer side of the cylinder block 11 (closer to right in FIG. 3) than the second communication passages 56 and 57 in the cylinder arrangement direction X.

In the present embodiment, there is only one third communication passage 65. The passage cross-sectional area of the third communication passage 65 is larger than the passage cross-sectional area of each of the second communication passages 56, 57 and is about the same as the passage cross-sectional area of the first communication passage. The third communication passage 65 is located at a position on the opposite side of the center of the second oil chamber 60 from the partition wall 43 in the cylinder arrangement direction X, and is located closer to the outer side (rightward in FIG. 3) of the cylinder head 12 than all the exhaust passages 21 in the cylinder arrangement direction X.

The first communication passage 55 includes a first opening 55*a* opened in the upper surface 121 of the cylinder head 12. The second communication passages 56, 57 include second openings 56*a*, 57*a* opened in the upper surface 121 of the cylinder head 12. The third communication passage 65 includes a third opening 65*a* opened in the upper surface 121 of the cylinder head 12. As shown in FIG. 3, the upper surface 121 is formed so that each of the second openings 56*a*, 57*a* is located above the first opening 55*a* and the third opening 65*a*.

As shown in FIGS. 3 and 4, the upper surface 121 is provided with a first extending wall 58 extending in a direction intersecting the cylinder arrangement direction X between the first opening 55*a* and the second opening 56*a*. The first extending wall 58 corresponds to an example of the extending wall provided between the first opening 55*a* and the second opening 56*a*. The first extending wall 58 is arranged closer to the second opening 56*a* than the middle between the second opening 56*a* and the first opening 55*a* in the cylinder arrangement direction X. More specifically, the first extending wall 58 is adjacent to the peripheral edge of the second opening 56*a*. As shown in FIG. 3, the upper surface 121 includes a first flow-down surface 59 inclined downward toward the first opening 55*a* in the cylinder arrangement direction X between the first opening 55*a* and the first extending wall 58. The first flow-down surface 59 corresponds to an example of the flow-down surface located between the first opening 55*a* and the first extending wall 58 on the upper surface 121.

Furthermore, as shown in FIGS. 3 and 4, the upper surface 121 is provided with a second extending wall 68 extending in a direction intersecting the cylinder arrangement direction X between the second opening 57*a* and the third opening 65*a*. The second extending wall 68 is arranged closer to the second opening 57*a* than the middle between the second opening 57*a* and the third opening 65*a* in the cylinder arrangement direction X. More specifically, the second extending wall 68 is adjacent to the peripheral edge of the second opening 57*a*. As shown in FIG. 3, the upper surface 121 includes a second flow-down surface 69 inclined downward toward the third opening 65*a* in the cylinder arrangement direction X between the third opening 65*a* and the second extending wall 68.

As shown in FIG. 3, in the cylinder head 12, the head-side cooling water passage 32 passes both immediately below the first flow-down surface 59 and immediately below the second flow-down surface 69. That is, the first flow-down surface 59 and the second flow-down surface 69 are arranged immediately above the head-side cooling water passage 32.

Figure 5:
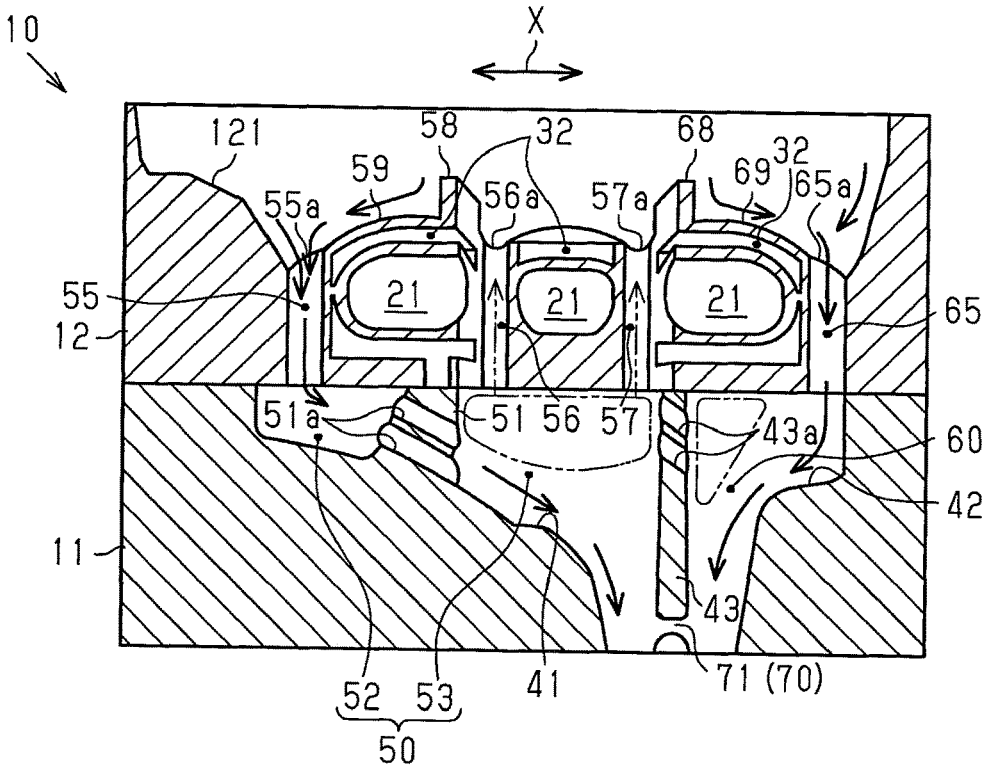
FIG. 5 is an operational view showing a state in which oil and gas flow in the internal combustion engine of FIG. 1.

Next, operations and advantages of the present embodiment will be described with reference to FIG. 5.

On the upper surface 121 of the cylinder head 12, the first opening 55*a* and the third opening 65*a* are located below the second openings 56*a*, 57*a*. The first extending wall 58 is disposed between the first opening 55*a* and the second opening 56*a*, and the second extending wall 68 is disposed between the third opening 65*a* and the second opening 57*a*. Thus, the oil flows toward the first opening 55*a* or the third opening 65*a* on the upper surface 121. In other words, the oil is less likely to flow toward the second openings 56*a*, 57*a* on the upper surface 121, and the oil in the space above the head is less likely to flow into the second communication passages 56, 57.

Furthermore, even if the amount of oil accumulated in the vicinity of the first opening 55*a* in the space above the head becomes large, the oil is regulated from flowing into the second communication passage 56 by the first extending wall 58. Similarly, even if the amount of oil accumulated in the vicinity of the third opening 65*a* in the space above the head becomes large, the oil is restricted from flowing into the second communication passage 57 by the second extending wall 68. With regards to such a point, the oil in the space above the head is less likely to flow into the second communication passages 56, 57.

Some of the oil flowing toward the first opening 55*a* along the upper surface 121 flows on the first flow-down surface 59. Some of the oil flowing toward the third opening 65*a* along the upper surface 121 flows on the second flow-down surface 69. Since the respective flow-down surfaces 59, 69 are disposed immediately above the head-side cooling water passage 32, the oil flowing on the respective flow-down surfaces 59, 69 can be cooled by the cooling water flowing through the head-side cooling water passage 32. The oil that has reached the first opening 55*a* flows into the first oil division chamber 52 of the first oil chamber 50 through the first communication passage 55 as indicated by a solid arrow in FIG. 5. After the oil in the first oil division chamber 52 flows into the second oil division chamber 53 through the through-hole 51*a*, the oil is returned to the oil pan 14 through the oil passage 70. Furthermore, the oil that has reached the third opening 65*a* along the upper surface 121 flows into the second oil chamber 60 through the third communication passage 65 as indicated by a solid arrow in FIG. 5. Then, the oil in the second oil chamber 60 is returned to the oil pan 14 through the oil passage 70.

When the engine rotation speed or the engine load factor increases, the amount of oil flowing into the space above the head increases, and hence a larger amount of oil flows toward the first oil chamber 50 from the space above the head through the first communication passage 55. Moreover, a larger amount of oil flows toward the second oil chamber 60 from the space above the head through the third communication passage 65. Furthermore, when the engine rotation speed or the engine load factor increases, the pressure in the crankcase 13 and the oil pan 14 increases. Therefore, the blow-by gas in the crankcase 13 flows backward through the oil passage 70 and flows into the first oil chamber 50 and the second oil chamber 60. As a result, the pressure in the first oil chamber 50 and the pressure in the second oil chamber 60 increase.

The first oil chamber 50 is partitioned into the first oil division chamber 52 and the second oil division chamber 53 by the partition wall 51. The oil passage 70 is connected to the second oil division chamber 53, but is not connected to the first oil division chamber 52. Therefore, the inflow of gas such as blow-by gas accumulated in the second oil division chamber 53 to the first oil division chamber 52 is restricted by the partition wall 51. Thus, the flow of the oil from the space above the head to the first oil division chamber 52 through the first communication passage 55 will not be inhibited by the gas accumulated in the first oil chamber 50. In FIG. 5, a region where gas is accumulated in the second oil division chamber 53 and the second oil chamber 60 is indicated by a chain double-dashed line.

In the second oil division chamber 53, gas is accumulated in the upper region thereof. That is, the gas is accumulated in the vicinity of the connecting portion with the second communication passages 56, 57 in the second oil division chamber 53. As described above, the oil barely flows into the second communication passages 56, 57 from the space above the head, as described above. Thus, the gas accumulated in the second oil division chamber 53 can be discharged to the outside of the first oil chamber 50 through the second communication passages 56, 57.

Therefore, even if a large amount of oil flows into the first oil chamber 50 through the first communication passage 55 or a large amount of blow-by gas flows into the first oil chamber 50 through the oil passage 70, the increase in the pressure of the first oil chamber 50 is limited since the gas accumulated in the second oil division chamber 53 is discharged to the outside of the first oil chamber 50 through the second communication passages 56, 57. As a result, the circulation of oil through the first communication passage 55 and the first oil chamber 50 can be properly carried out. The content of air bubbles can be lowered in the oil returned from the second oil division chamber 53 into the oil pan 14 through the oil passage 70 by reducing the amount of gas accumulated in the second oil division chamber 53.

On the other hand, only one communication passage connecting the second oil chamber 60 and the space above the head, that is, the third communication passage 65 is provided. That is, the resistance generated when causing gas to flow from the second oil chamber 60 to the space above the head through the third communication passage 65 is larger than the resistance generated when causing gas to flow from the first oil chamber 50 to the space above the head through the first communication passages 55 to 57. Thus, when a large amount of blow-by gas flows from the oil pan 14 through the oil passage 70, the flow of oil from the space above the head to the second oil chamber 60 through the third communication passage 65 may be inhibited by the gas accumulated in the second oil chamber 60.

In this regard, in the present embodiment, the second oil chamber 60 communicates with the second oil division chamber 53 through the connection hole 43*a* provided in the partition wall 43. Therefore, even if the discharge performance of the gas from the second oil chamber 60 to the space above the head through the third communication passage 65 is low, the gas accumulated in the second oil chamber 60 can be flowed out to the second oil division chamber 53 through the connection hole 43*a*. The gas that has flowed into the second oil division chamber 53 is discharged into the space above the head through the second communication passages 56, 57. Thus, the gas is not continuously accumulated in the second oil chamber 60. As a result, the flow of oil from the space above the head to the second oil chamber 60 through the third communication passage 65 is not inhibited by the gas accumulated in the second oil chamber 60. Therefore, the oil that has flowed into the second oil chamber 60 through the third communication passage 65 can be properly returned to the oil pan 14 through the oil passage 70. The content of air bubbles can be lowered in the oil returned from the second oil chamber 60 to the oil pan 14 through the oil passage 70 by reducing the amount of gas accumulated in the second oil chamber 60.

Gas tends to easily accumulate in the upper region of the second oil chamber 60. In this regard, in the present embodiment, the connection hole 43*a* is disposed at a portion of the partition wall 43 above the center in the vertical direction. Therefore, the gas accumulated in the second oil chamber 60 can easily flow out to the second oil division chamber 53 through the connection hole 43*a*.

Furthermore, since the gas that has flowed into the second oil chamber 60 flows out to the second oil division chamber 53 through the connection hole 43*a*, the gas easily accumulates near the partition wall 43 in the second oil chamber 60. In this regard, in the present embodiment, the second oil chamber 60 is connected to the third communication passage 65 on the opposite side of the center of the second oil chamber 60 from the partition wall 43 in the cylinder arrangement direction X. Therefore, even if the gas is accumulated in the second oil chamber 60, the flow of oil from the space above the head to the second oil chamber 60 through the third communication passage 65 is less likely to be inhibited. Furthermore, the gas accumulated in the second oil chamber 60 is easily pushed out to the second oil division chamber 53 through the connection hole 43*a* by the force of the oil flowing into the second oil chamber 60 through the third communication passage 65.

The present embodiment further has the following advantages.

(1) The first oil chamber 50 and the second oil chamber 60 are respectively disposed near the block side cooling water passage 31. The connecting portion of the oil passage 70 with respect to the first oil chamber 50 is separated from the connecting portion of the first communication passage 55 with respect to the first oil chamber 50 in the cylinder arrangement direction X. Therefore, the time in which the oil that has flowed into the first oil chamber 50 through the first communication passage 55 is accumulated in the first oil chamber 50 is longer as compared with the case where the connecting portion of the first communication passage 55 with respect to the first oil chamber 50 is disposed near the connecting portion of the oil passage 70 with respect to the first oil chamber 50. As a result, the oil can be cooled by the cooling water flowing through the block side cooling water passage 31 in the course of the oil flowing toward the oil passage 70 in the first oil chamber 50. Therefore, the oil at a relatively low temperature can be returned to the oil pan 14.

(2) The passage cross-sectional area of each of the first communication passage 55 and the third communication passage 65 is wider than the passage cross-sectional area of each of the second communication passages 56, 57. Thus, the oil in the space above the head is easily returned to the oil pan 14 through each of the first communication passage 55 and the third communication passage 65 as compared with the case where the passage cross-sectional area of each of the first communication passage 55 and the third communication passage 65 is substantially equal to the passage cross-sectional area of each of the second communication passages 56, 57.

(3) The vehicle may accelerate in the cylinder arrangement direction X depending on the traveling mode of the vehicle on which the internal combustion engine 10 of the present embodiment is mounted. In this case, in the space above the head, the oil tends to easily accumulate on the outer side than the center in the cylinder arrangement direction X due to the inertia force of the oil in the cylinder arrangement direction X. In this regard, in the present embodiment, the first communication passage 55 and the third communication passage 65 are disposed on the outer side than the second communication passages 56, 57 in the cylinder arrangement direction X in the cylinder block 11. Therefore, even in the case where the acceleration in the cylinder arrangement direction X acts on the internal combustion engine 10, a state where the oil accumulated in the space above the head is easily flowed into the oil chambers 50, 60 through either one of the first communication passage 55 and the third communication passage 65 can be maintained, and state where the gas accumulated in the second oil division chamber 53 is easily discharged to the outside of the oil chamber through the second communication passages 56, 57 can be maintained.

(4) At the portion between the two exhaust passages 21 adjacent to each other in the cylinder arrangement direction X of the cylinder head 12, the temperature tends to increase due to the heat from the exhaust gas flowing through both exhaust passages 21. In this respect, in the present embodiment, the temperature rise of the oil flowing toward the first oil division chamber 52 through the first communication passage 55 is suppressed because the first communication passage 55 is not disposed between the two exhaust passages 21 adjacent to each other in the cylinder arrangement direction X. The enlargement of the internal combustion engine 10 in the cylinder arrangement direction X is suppressed because the second communication passages 56, 57 are not arranged on the outer side of the cylinder head 12 than the first communication passage 55 in the cylinder arrangement direction X.

The above-described embodiment may be modified as follows. The above-described embodiment and the following modifications can be combined as long as the combined modifications remain technically consistent with each other.

In the embodiment described above, the first flow-down surface 59 is formed so as to be inclined downward toward the first opening 55*a* in the cylinder arrangement direction X. However, as long as the first flow-down surface 59 is formed so as to be located more downward as it approaches the first opening 55*a* in the cylinder arrangement direction X, the first flow-down surface 59 may have a shape different from the shape described in the embodiment described above. For example, the first flow-down surface 59 may be formed so as to be located downward in a stepwise manner as it approaches the first opening 55*a* in the cylinder arrangement direction X.

In the embodiment described above, the second flow-down surface 69 is formed so as to be inclined downward toward the third opening 65*a* in the cylinder arrangement direction X. However, as long as the second flow-down surface 69 is formed so as to be located more downward as it approaches the third opening 65*a* in the cylinder arrangement direction X, the second flow-down surface 69 may have a shape different from the shape described in the embodiment described above. For example, the second flow-down surface 69 may be formed so as to be located more downward in a stepwise manner as it approaches the third opening 65*a* in the cylinder arrangement direction X.

The first extending wall 58 may be disposed at an intermediate position of the first flow-down surface 59 in the cylinder arrangement direction X.

The second extending wall 68 may be disposed at an intermediate position of the second flow-down surface 69 in the cylinder arrangement direction X.

As long as the flowing amount of oil from the space above the head to the first oil chamber 50 through the first communication passage 55 can be sufficiently ensured, the passage cross-sectional area of the first communication passage 55 does not necessarily need to be larger than the passage cross-sectional area of each of the second communication passages 56, 57. For example, the passage cross-sectional area of the first communication passage 55 may be equal to the passage cross-sectional area of each of the second communication passages 56, 57, or may be narrower than the passage cross-sectional area of each of the second communication passages 56, 57.

As long as the flowing amount of oil from the space above the head to the second oil chamber 60 through the third communication passage 65 can be sufficiently ensured, the passage cross-sectional area of the third communication passage 65 does not necessarily need to be larger than the passage cross-sectional area of each of the second communication passages 56, 57. For example, the passage cross-sectional area of the third communication passage 65 may be equal to the passage cross-sectional area of each of the second communication passages 56, 57, or may be narrower than the passage cross-sectional area of each of the second communication passages 56, 57.

As long as the connecting portion of the oil passage 70 with respect to the first oil chamber 50 is arranged closer to the connecting portion of the second communication passages 56, 57 with respect to the first oil chamber 50 than the connecting portion of the first communication passage 55 with respect to the first oil chamber 50, the first communication passage 55 may be disposed on the inner side in the cylinder arrangement direction X than the second communication passages 56, 57 in the cylinder block 11.

As long as the connecting portion of the oil passage 70 with respect to the second oil chamber 60 is arranged closer to the connecting portion of the second communication passage 57 with respect to the first oil chamber 50 than the connecting portion of the third communication passage 65 with respect to the second oil chamber 60, the third communication passage 65 may be disposed on the inner side in the cylinder arrangement direction X than the second communication passages 56, 57 in the cylinder block 11.

The number of first communication passages 55 connected to the first oil division chamber 52 may be an arbitrary number of two or more (e.g., two).

The number of second communication passages connected to the second oil division chamber 53 may be an arbitrary number of three or more (e.g., four). Furthermore, the number of second communication passages may be one as long as the discharge efficiency of the gas accumulated in the second oil division chamber 53 to the space above the head can be sufficiently secured.

An arbitrary number (e.g., four) of three or more connection holes 43*a* may be provided in the partition wall 43. The number of connection holes 43*a* provided in the partition wall 43 may be one as long as the amount of outflow of the gas from the second oil chamber 60 to the second oil division chamber 53 can be sufficiently ensured.

As long as the gas accumulated in the second oil chamber 60 can be properly allowed to flow out to the second oil division chamber 53, the connection hole 43*a* may be disposed at an intermediate position in the vertical direction of the partition wall 43 or may be disposed at a position on the lower side than the middle in the vertical direction of the partition wall 43.

The partition wall 51 may be omitted as long as the rigidity of the cylinder block 11 can be sufficiently ensured without providing the partition wall 51. In this case, the first oil chamber 50 is not divided into two oil division chambers 52, 53.

Figure 6:
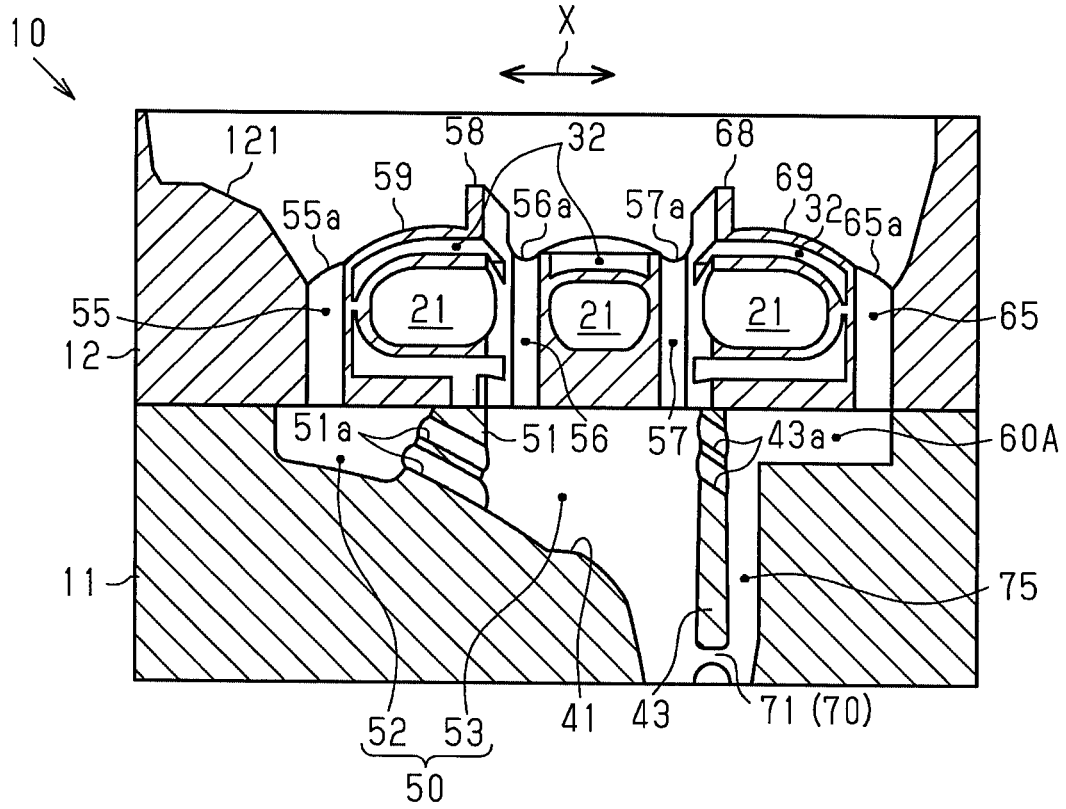
FIG. 6 is a cross-sectional view schematically showing a cylinder block and a cylinder head in an internal combustion engine according to another embodiment.

As shown in FIG. 6, the second oil chamber may be a second oil chamber 60A having such a shape that the depth at each position in the cylinder arrangement direction X is substantially the same. In this case, in the cylinder block 11, a connecting passage 75 connecting the second oil chamber 60A and the oil passage 70 is provided along the partition wall 43.

A plurality of communication passages that are opened to the space above the head and connected to the second oil chamber 60 may be provided. In this case, the communication passages may include the third communication passage 65 and a fourth communication passage different from the third communication passage 65. The connecting portion of the fourth communication passage with respect to the second oil chamber 60 may be arranged closer to the partition wall 43 in the cylinder arrangement direction X than the connecting portion of the third communication passage 65 with respect to the second oil chamber 60. In this case, the gas accumulated in the second oil chamber 60 can be discharged to the outside of the second oil chamber 60 through the fourth communication passage. Therefore, the connection hole 43*a* does not necessarily need to be provided in the partition wall 43.

As long as the number of cylinders 15 provided in the cylinder block 11 is an odd number of three or more, the number of cylinders 15 may be an arbitrary number (e.g., five) other than three.

The number of cylinders 15 provided in the cylinder block 11 may be an even number (e.g., four). In this case, the volume of the first oil chamber 50 does not necessarily need to be larger than the volume of the second oil chamber 60. For example, the volume of the first oil chamber 50 may be equal to the volume of the second oil chamber 60, or may be smaller than the volume of the second oil chamber 60.

The invention claimed is:

1. An in-vehicle internal combustion engine comprising:

a cylinder block having a plurality of cylinders arranged in a cylinder arrangement direction and having a recess; and a cylinder head attached to the cylinder block, the cylinder head closing the recess to form an oil chamber in the cylinder block, wherein the cylinder head includes a plurality of communication passages opened in an upper surface of the cylinder head and connected to the oil chamber, the communication passages being arranged in the cylinder arrangement direction, the cylinder block includes an oil passage for returning oil accumulated in the oil chamber into an oil pan, the communication passages include a first communication passage having a first opening opened in the upper surface of the cylinder head and a second communication passage having a second opening opened in the upper surface of the cylinder head, the first opening being located below the second opening, an extending wall extending in a direction intersecting the cylinder arrangement direction is provided between the first opening and the second opening on the upper surface of the cylinder head, the extending wall extends upward from the upper surface, a connecting portion of the oil passage with respect to the oil chamber is located closer to a connecting portion of the second communication passage with respect to the oil chamber than a connecting portion of the first communication passage with respect to the oil chamber, the cylinder block includes a partition wall that partitions the oil chamber into a first oil division chamber and a second oil division chamber adjacent to the first oil division chamber in the cylinder arrangement direction, the first communication passage is connected to the first oil division chamber and is not connected to the second oil division chamber, the second communication passage and the oil passage are not connected to the first oil division chamber and are connected to the second oil division chamber, and the partition wall includes a through-hole that allows the first oil division chamber and the second oil division chamber to communicate with each other.

2. The in-vehicle internal combustion engine according to claim 1, wherein the first communication passage is disposed closer to an outer side of the cylinder head than the second communication passage in the cylinder arrangement direction.

3. The in-vehicle internal combustion engine according to claim 1, wherein the cylinder head includes a plurality of exhaust passages respectively connected to the cylinders, the second communication passage is disposed between the exhaust passages adjacent to each other in the cylinder arrangement direction, and the first communication passage is disposed closer to an outer side of the cylinder head than the exhaust passages in the cylinder arrangement direction.

4. The in-vehicle internal combustion engine according to claim 1, wherein a passage cross-sectional area of the first communication passage is larger than a passage cross-sectional area of the second communication passage.

5. The in-vehicle internal combustion engine according to claim 1, wherein the recess is a first recess, and the oil chamber is a first oil chamber, the cylinder block includes a second recess arranged side by side with the first recess in the cylinder arrangement direction and the partition wall located between the first and second recesses, the cylinder head closes the second recess to form a second oil chamber arranged in the cylinder arrangement direction with the first oil chamber with the partition wall therebetween in the cylinder block;

the cylinder head includes a third communication passage opened in the upper surface of the cylinder head and communicating with the second oil chamber; and the oil passage is connected to both the first oil chamber and the second oil chamber.

6. The in-vehicle internal combustion engine according to claim 1, wherein the upper surface of the cylinder head includes a flow-down surface formed between the extending wall and the first opening so as to be located more downward as the flow-down surface approaches the first opening in the cylinder arrangement direction, and the flow-down surface is disposed immediately above a cooling water passage provided inside the cylinder head.

* * * * *